US006606984B2

(12) United States Patent
Mugg

(10) Patent No.: US 6,606,984 B2
(45) Date of Patent: Aug. 19, 2003

(54) PNEUMATIC TIME DELAYED BOWSTRING RELEASE

(76) Inventor: David Ross Mugg, 2663 Valleydale Rd. Box 249, Birmingham, AL (US) 35244

( * ) Notice: Subject to any disclaimer, the term of this patent is extended or adjusted under 35 U.S.C. 154(b) by 104 days.

(21) Appl. No.: 09/846,633

(22) Filed: May 1, 2001

(65) Prior Publication Data

US 2002/0162546 A1 Nov. 7, 2002

(51) Int. Cl.[7] ..... F41B 5/18
(52) U.S. Cl. ..... 124/35.2
(58) Field of Search ..... 124/35.2

(56) References Cited

U.S. PATENT DOCUMENTS

| | | | | |
|---|---|---|---|---|
| 1,179,301 A | | 4/1916 | Hammond | |
| 1,909,416 A | | 5/1933 | Nemmers | |
| 2,072,746 A | | 3/1937 | Foster et al. | |
| 3,770,981 A | | 11/1973 | Nelson | |
| 4,674,469 A | | 6/1987 | Peck | |
| 4,823,761 A | | 4/1989 | Lewis | |
| 5,224,463 A | | 7/1993 | Townsend | |
| 5,370,102 A | * | 12/1994 | Peck | 124/35.2 |
| 5,494,023 A | | 2/1996 | Kolak | |
| 5,546,924 A | | 8/1996 | Todd | |
| 5,566,664 A | | 10/1996 | Todd | |
| 5,575,269 A | | 11/1996 | Harklau | |
| 6,125,833 A | | 10/2000 | Tentler et al. | |
| 6,247,467 B1 | * | 6/2001 | Siegfried | 124/35.2 |

* cited by examiner

*Primary Examiner*—John A. Ricci

(57) ABSTRACT

A pneumatic time delayed bowstring release apparatus for use with a bowstring affixed to a bow. The bowstring release apparatus comprises a release mechanism operated by a trigger that is time delayed by a pneumatic vacuum cylinder. The time delay of the pneumatic vacuum cylinder is dependent upon the rate of air flow into the vacuum cylinder, which is controlled by an adjustable air intake valve.

6 Claims, 1 Drawing Sheet

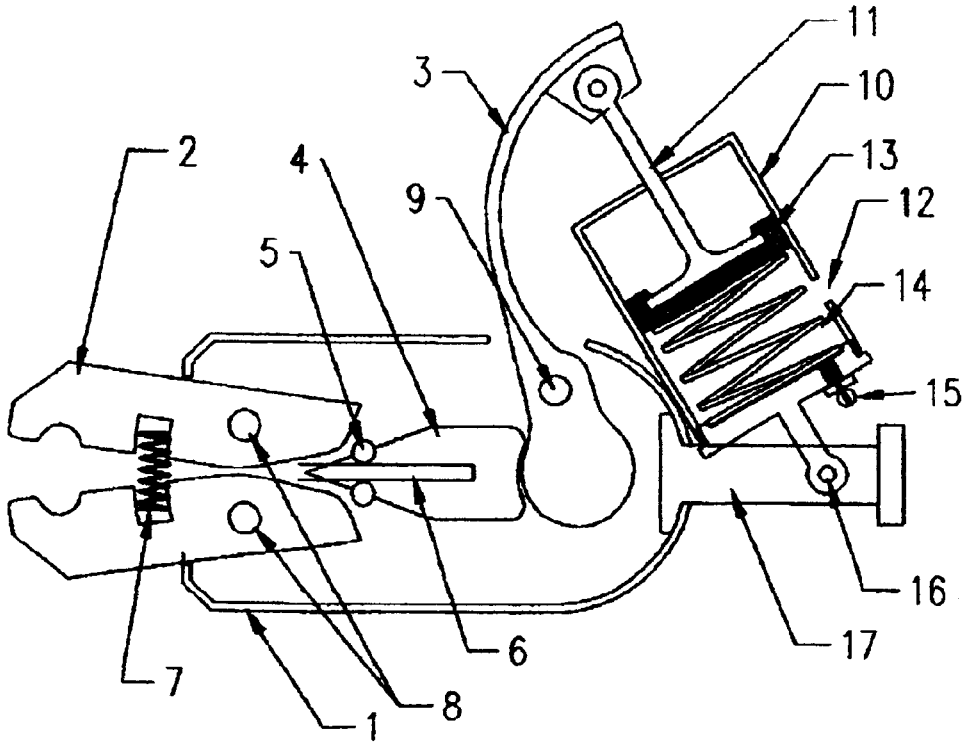
FIGURE 1 – OPEN POSITION
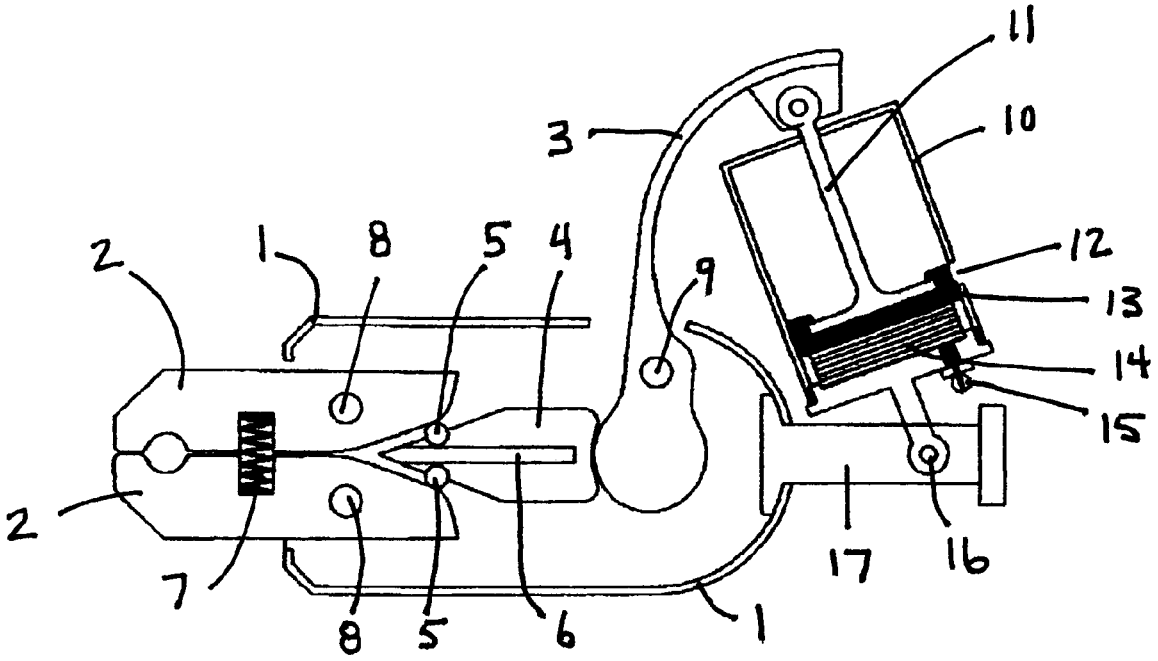
FIGURE 2 – CLOSED POSITION

PNEUMATIC TIME DELAYED BOWSTRING RELEASE

FIELD OF THE INVENTION

The present invention relates to the field of archery and specifically to time delayed bowstring release devices used to mechanically release the bowstring for greater accuracy.

BACKGROUND OF THE INVENTION

Improvements in technology within the field of archery have brought about many changes in bows and shooting technique. Compound bows shoot at a much faster speed than the older recurves and straight bows. The faster speeds have brought about a much greater need for accuracy. Accuracy is directly affected by the manner in which the archer releases the arrow. Historically, archers used their fingers to release the arrows. This proved to be very difficult due to the fact that there was inconsistency in the way that the bowstring would come off the ends of the fingers. As technology changed, archers began to utilize mechanical release devices. These devices provided much greater accuracy because the release was very consistent.

A psychosomatic reaction commonly referred to as "target panic" is a phenomenon that takes place when the archer flinches at the exact time of release of the arrow, thus adversely affecting the destination of the shot. The psychological anticipation of shock coming from the bow release causes this uncontrollable reflex. Many products have been developed to help alleviate this problem. However, most of the products involve some physical force on the part of the archer to release the arrow.

Many bowstring release devices currently exist that utilize a trigger pull mechanism to fire the bow. These mechanisms require that the archer apply a steady pressure without any target panic. By way of example, U.S. Pat. No. 5,224,463 to Townsend discloses a manually-operated bowstring release device and U.S. Pat. No. 5,546,924 to Todd discloses a similar apparatus using a roller device.

Other devices are in existence that involve a hinge release mechanism in which the archer exerts a back pulling motion to release the arrow. These devices are generally classified as back-tension releases. These devices involve a physical pulling action on the part of the archer. The archer does not have an exact awareness of exactly when the bow will fire. While there is significant improvement over trigger release devices, there is still the possibility of target panic or jerking the device.

Electronic time delay bowstring release devices allow the archer to activate a switch to activate the device. The time delay is performed electronically and is adjustable and available with a random delay feature. For example, U.S. Pat. No. 5,494,023 to Kolak discloses a bowstring release apparatus using an electrical time delayed release device and U.S. Pat. No. 5,575,269 to Harklau discloses an electronic time delay with a random delay feature. The electronic time delay devices were found to be less reliable, and in some cases, were considered unsafe for use by some archers. The batteries used to operate these devices tended to expire without warning and many times caused inconsistency and even failure in operation during critical shots.

SUMMARY OF THE INVENTION

The present invention provides a pneumatic time delayed bowstring release apparatus having a safer operation and more reliable function than prior art devices. The present invention incorporates all of the advantages of a time delayed operation, except for the randomizing function that is not considered by some archers to be an advantage. The apparatus does not rely on batteries that expire without warning or cause inconsistency in timing of the operation of the apparatus.

The invention is a pneumatic time delayed bowstring release apparatus for use with a bowstring affixed to a bow. The apparatus comprises a housing, a pair of caliper release heads pivotally connected to the housing and designed to receive and hold a bowstring, a trigger pivotally connected to the housing, a wedge-shaped plate having an integral groove for slidably moving along a spline track in the housing, a spring to bias the caliper heads in an "open" position, a pneumatic chamber, a pneumatic piston pivotally connected at one end to the trigger, an air relief vent, a spring to bias the piston in an "open" position, and an adjustable air intake control valve.

In operation, the archer depresses the trigger which pivots a portion of the trigger into the wedge-shaped plate and thereby forces the wedge-shaped plate into engagement with the ends of the caliper heads to pivot the caliper heads into a "closed" position to grip the bowstring. As the trigger is depressed, it also forces the piston through the pneumatic chamber, which evacuates air from the chamber through the air vent thereby forming a vacuum in the chamber. With the apparatus in the "closed" position, the archer can then draw the bow and take aim at a target. Once the archer releases the trigger, air will enter the chamber through the air intake control valve, which is adjustable to control the rate at which air enters the chamber. As the chamber refills with air, the piston is urged back through the chamber, thereby pivoting the trigger out of engagement with the wedge-shaped plate and allowing the wedge-shaped plate to disengage from the caliper heads, thereby allowing the caliper heads to resume the "open" position and release the bowstring.

BRIEF DESCRIPTION OF THE DRAWINGS

FIG. 1 is a side sectional view of the pneumatic time delayed bowstring release apparatus in an open position.

FIG. 2 is a side sectional view of the pneumatic time delayed bowstring release apparatus in a closed position.

DETAILED DESCRIPTION OF THE PREFERRED EMBODIMENTS

The pneumatic time delayed bowstring release apparatus embodying the principles and concepts of the present invention will be described herein. Referring to FIGS. 1 and 2, the apparatus comprises a support body housing 1, a pair of caliper release heads 2 designed to receive and hold a bowstring, a trigger 3 pivotally connected to the housing 1, a wedge-shaped plate 4 having anti-friction devices 5 on both sides of the wedge-shaped plate 4 and an integral groove to receive a spline 6, a spring 7 to bias the caliper heads 2 in an "open" position (see FIG. 1), attachment screws 8 to pivotally connect the caliper heads 2 to the housing 1, a pivotal connection 9 to secure the trigger 3 to the housing 1, a pneumatic chamber 10 pivotally connected at one end 16 to a support body connector 17, a pneumatic piston 11 pivotally connected at one end to the trigger 3, an air relief vent 12, an air seal gasket 13, a spring 14 to bias the piston 11 in an "open" position (see FIG. 1), and an adjustable air intake control valve 15.

The support body housing 1 is coupled to the support body connector 17 by a pivotal connection allowing for minor rotational movement of the apparatus during the drawing process. The end of the support body connector 17 is designed to connect to a grip or wrist pull attachment (not shown) used to pull the apparatus during the bowstring drawing process.

In operation, the archer depresses the trigger 3 which pivots the rounded base of the trigger 3 into the wedge-shaped plate 4 and thereby forces the wedge-shaped plate 4 into engagement with the ends of the caliper heads 2 to pivot the caliper heads 2 into a "closed" position (see FIG. 2) to grip the bowstring. The anti-friction devices 5 allow the wedge-shaped plate 4 to engage the ends of the caliper heads 2 with minimal resistance. As the trigger 3 is depressed, it also forces the piston 11 through the air chamber 10, which evacuates air from the chamber 10 through the air vent 12 thereby forming a vacuum in the chamber. With the apparatus in the "closed" position (see FIG. 2), the archer can then draw the bow and take aim at a target. Once the archer releases the trigger, air will enter the chamber 10 through the air intake control valve 15, which is adjustable to control the rate at which air enters the chamber 10. As the chamber 10 refills with air, the piston 11 is urged back through the chamber 10 by the biasing spring 14, thereby pivoting the rounded base of the trigger 3 out of engagement with the wedge-shaped plate 4 and allowing the wedge-shaped plate 4 to disengage from the caliper heads 2, thereby allowing the caliper heads 2 to resume the "open" position (see FIG. 1) and release the bowstring.

By adjusting the air intake control valve 15, the archer can adjust the time delay associated with release of the bowstring. Accordingly, the bowstring is held by the pneumatic time delayed bowstring release apparatus after the archer releases the trigger 3 until the predetermined time period expires, after which, the caliper heads 2 open to release the bowstring and fire the projectile. Alternately, the bow may be released or let down at any time prior to firing. Further, the archer can simply apply finger pressure on the trigger 3 to prevent initiation of the time delay function of the apparatus, thus offering a safer means of operation.

The description and explanation of the concept surrounding and relating to this invention is intended to depict general relationships of operation. It is anticipated that modifications, refinements, and changes will occur to those skilled in the art. It is not desired or intended that this invention be limited to the exact construction and operation shown or illustrated herein. All suitable modifications, refinements, enhancements, and minor changes to this concept are intended to be within the scope of this invention.

What is claimed is:

1. A pneumatic time delayed bowstring release apparatus, comprising:

a housing;

a pair of elongated members pivotally mounted within said housing, wherein each member has a first end and a second end;

means for biasing said first ends of said elongated members apart;

a wedge slidably mounted within said housing, wherein said wedge is operable to slidably engage said second ends of said elongated members and thereby pivot said elongated members such that said first ends of said elongated members abut;

a cylindrical air chamber having a first end, a second end, a purge valve, and an air valve for controlling air flow into the chamber at a predetermined rate;

a piston slidably mounted within said air chamber, wherein said piston has a first end extending through the first end of said air chamber and a second end that forms an air tight seal with internal sidewalls of said air chamber, wherein said piston is operable to purge air from said air chamber as said second end of said piston is urged towards said second end of said air chamber;

means for biasing said second end of said piston towards said first end of said air chamber; and a trigger pivotally mounted within said housing, wherein said trigger has a first end and a second end, wherein said first end of said trigger is attached to said first end of said piston and is operable to urge said second end of said piston towards said second end of said air chamber and said second end of said trigger is operable to engage said wedge and thereby urge said wedge into engagement with said second ends of said elongated members.

2. An apparatus according to claim 1, wherein depression of said trigger concurrently urges said second end of said piston towards said second end of said air chamber to purge air from said air chamber and urges said wedge into engagement with said second ends of said elongated members to pivot said first ends of said elongated members into abutment.

3. An apparatus according to claim 2, wherein release of said depressed trigger allows air to flow at a predetermined rate into said chamber through said air valve to urge said second end of said piston towards said first end of said air chamber, thereby pivoting said second end of said trigger out of engagement with said wedge after a predetermined time period so that said wedge will disengage said second ends of said elongated members to allow said first ends of said elongated members to pivot apart.

4. A pneumatic time delayed bowstring release apparatus, comprising:

means for clasping a bowstring; and means for releasing the bowstring after a predetermined time period, wherein said means for releasing comprises an air chamber having means for purging said chamber of air and means for allowing air to reenter said chamber at a predetermined rate, wherein said time period is dependent upon a predetermined volume of air reentering said chamber such that said means for releasing is activated to release the bowstring after said predetermined volume of air reenters said chamber.

5. An apparatus according to claim 4, wherein said means for clasping comprises:

a pair of elongated members pivotally mounted within a housing, wherein each member has a first end and a second end;

means for biasing said first ends of said elongated members apart;

a wedge slidably mounted within said housing, wherein said wedge is operable to slidably engage said second ends of said elongated members and thereby pivot said elongated members such that said first ends of said elongated members abut; and a trigger pivotally mounted within said housing, wherein said trigger has a first end and a second end, wherein said second end of said trigger is operable to engage said wedge and thereby urge said wedge into engagement with said second ends of said elongated members;

wherein depression of said trigger urges said wedge into engagement with said second ends of said elongated members to pivot said first ends of said elongated members into abutment.

6. An apparatus according to claim 5, wherein said means for releasing comprises:

a cylindrical air chamber having a first end, a second end, a purge valve, and an air valve for allowing air to enter the chamber at a predetermined rate;

a piston slidably mounted within said air chamber, wherein said piston has a first end extending through the first end of said air chamber and a second end that forms an air tight seal with internal sidewalls of said air chamber, wherein said piston is operable to purge air from said air chamber as said second end of said piston is urged towards said second end of said air chamber; and means for biasing said second end of said piston towards said first end of said air chamber;

wherein said first end of said trigger is attached to said first end of said piston such that depression of said trigger urges said second end of said piston towards said second end of said air chamber to purge air from said air chamber and release of said depressed trigger allows air to flow at a predetermined rate into said chamber through said air valve to urge said second end of said piston towards said first end of said air chamber, thereby pivoting said second end of said trigger out of engagement with said wedge after a predetermined time period so that said wedge will disengage said second ends of said elongated members to allow said first ends of said elongated members to pivot apart.

* * * * *